US006219860B1

(12) United States Patent
Chang

(10) Patent No.: US 6,219,860 B1
(45) Date of Patent: Apr. 24, 2001

(54) FAUCET ASSEMBLY HAVING OVERLAPPING SPOUTS FOR RELEASING FILTERED AND UNFILTERED WATER THEREFROM

(75) Inventor: Ta-Chun Chang, Taichung Hsien (TW)

(73) Assignee: Globe Union Industrial Corp., Taiwan (CN)

( * ) Notice: Subject to any disclaimer, the term of this patent is extended or adjusted under 35 U.S.C. 154(b) by 0 days.

(21) Appl. No.: 09/587,013

(22) Filed: Jun. 5, 2000

(51) Int. Cl.[7] ..... E03C 1/04
(52) U.S. Cl. ..... 4/678; 137/801; 239/445
(58) Field of Search ..... 4/678; 137/801; 239/445

(56) References Cited

U.S. PATENT DOCUMENTS 1,550,448 * 8/1925 Newton ..... 4/678 X
4,077,545 * 3/1978 Karis ..... 137/801 X
5,634,220 * 6/1997 Chiu ..... 4/678

* cited by examiner

*Primary Examiner*—Robert M. Fetsuga
(74) *Attorney, Agent, or Firm*—Akin, Gump, Strauss, Hauer & Feld, L.L.P.

(57) ABSTRACT

A faucet assembly includes synchronously rotatable first and second spouts for releasing filtered and unfiltered water therefrom.

3 Claims, 6 Drawing Sheets

FAUCET ASSEMBLY HAVING OVERLAPPING SPOUTS FOR RELEASING FILTERED AND UNFILTERED WATER THEREFROM

BACKGROUND OF THE INVENTION

1. Field of the Invention

This invention relates to a faucet assembly, more particularly to a faucet assembly which has two spouts for releasing filtered and unfiltered water therefrom.

2. Description of the Related Art

Referring to FIG. 1, a conventional faucet assembly is shown to include a faucet body 1, a tubular housing 2, a spout 4 and a control knob 3.

As illustrated, the faucet body 1 defines a water passage chamber having a cold water inlet adapted to be connected fluidly with a cold water supply source 111, a hot water inlet adapted to be connected fluidly with a hot water supply source 112, and a water outlet for discharging water therefrom.

The tubular housing 2 is sleeved rotatably around the faucet body 1, and has a peripheral wall with upper and lower ends establishing a water-tight seal in cooperation with the faucet body 1 so as to define an annular chamber between the tubular housing 2 and the faucet body 1, and between the upper and lower ends of the peripheral wall. The annular chamber is in fluid communication with the water passage chamber via the water outlet. The housing 2 further has a spout mounting port which is in fluid communication with the annular chamber and from which the spout 4 extends integrally and outwardly so as to guide the water inside the annular chamber to an exterior of the faucet assembly.

The control knob 3 is mounted on the tubular housing 2 for regulating and stopping flow of the water from the annular chamber to the exterior of the faucet assembly.

Since the aforesaid conventional faucet assembly is provided with only one spout, water discharged therefrom is generally not filtered and is thus fit only for washing and common use. In order to obtain drinking water, a two-spout faucet assembly 10 (see FIG. 1A) is provided with two spouts that are spaced apart from each other. As a result, a relatively large sink is needed to be disposed under two spouts of the assembly 10 (see FIG. 1A).

SUMMARY OF THE INVENTION

Therefore, the object of this invention is to provide a faucet assembly with two spouts that are adapted to release filtered and unfiltered water therefrom and that are disposed in an overlapping manner for use with a volume-reduced sink.

Accordingly, the faucet assembly of the present invention includes a faucet body, a tubular housing, a hollow tube, a first spout, a second spout, and first and second control knobs. The faucet body includes an upper faucet portion defining a first water passage chamber having a cold water inlet adapted to be connected fluidly with a cold water supply source, a hot water inlet adapted to be connected fluidly with a hot water supply source, and a first water outlet. The faucet body further includes a lower faucet portion defining a second water passage chamber isolated fluidly from the first water passage chamber. The second water passage chamber has an inlet adapted to be connected fluidly with a filtered water source so as to receive filtered water therefrom, and a second water outlet adapted for discharging the filtered water therefrom. The housing is sleeved rotatably around the faucet body, and includes an upper housing portion that establishes a first water-tight seal in cooperation with the upper faucet portion so as to define a first annular chamber therebetween in communication with the first water passage chamber via the first water outlet and that is formed with a first spout mounting port, and a lower housing portion that is disposed around the lower faucet portion and that defines an annular tube accommodating space therebetween. The tube has an axial length and a width that are smaller than those of the housing, and is disposed inside the tube accommodating space. The tube has a peripheral wall with two opposite ends connected to the lower faucet portion so as to establish a second water-tight seal and a second annular chamber between the lower faucet portion and the peripheral wall, and between the opposite ends of the peripheral wall of the tube. The second annular chamber is in fluid communication with the second water passage chamber via the second water outlet. The tube has a second spout mounting port formed in the peripheral wall and in fluid communication with the second annular chamber. The first spout extends integrally, radially and outwardly from the upper housing portion and is in fluid communication with the first spout mounting port for guiding water outwardly from the first annular chamber. The second spout is operably associated with the first spout so as to synchronously rotate therewith relative to the faucet body. The second spout extends generally parallel with the first spout and through the lower housing portion and is connected integrally to the tube. The second spout is in fluid communication with the second spout mounting port so as to be adapted to guide the filtered water outwardly from the second annular chamber. The first control knob is mounted on the tubular housing for selectively closing and opening the cold and hot water inlets and the first outlet upon operation thereof. The second control knob is adapted to regulate and stop flow of the filtered water to the second spout mounting port in the tube.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
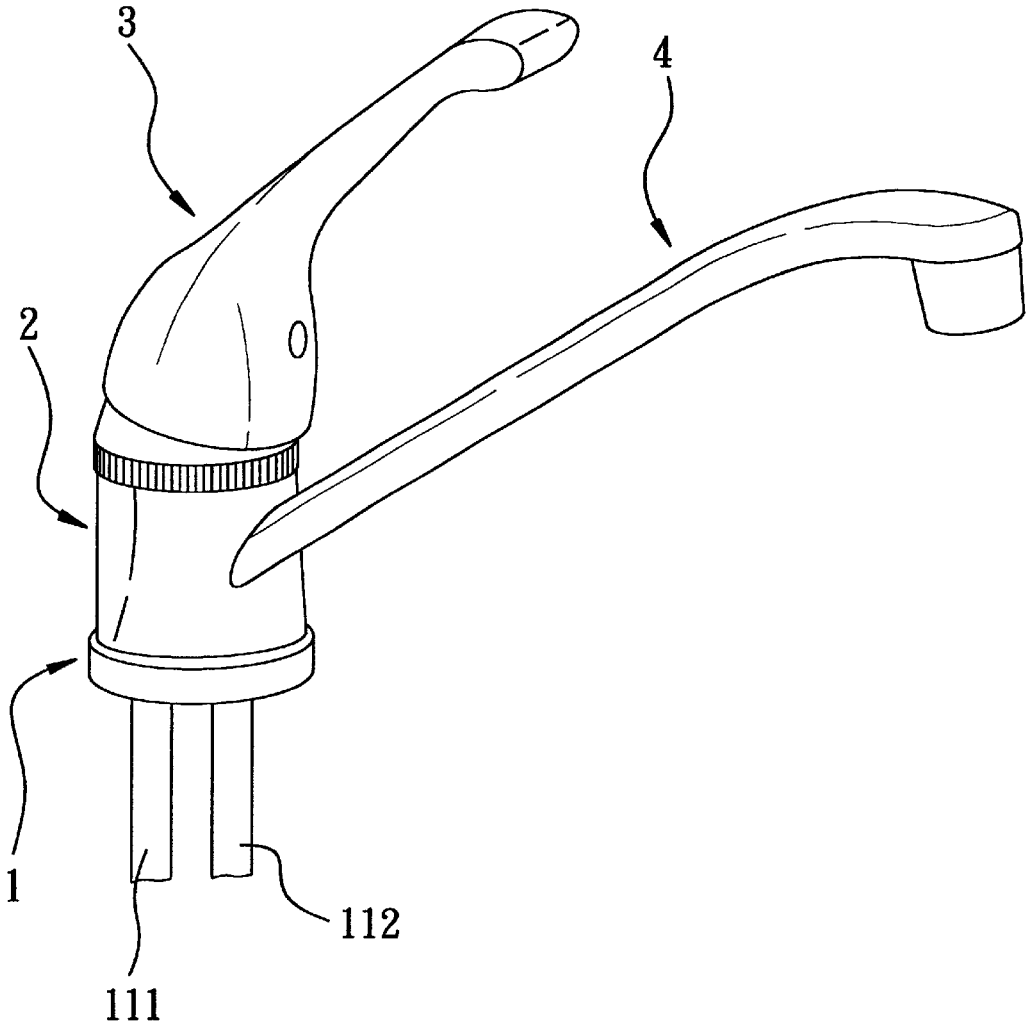
FIG. 1 PRIOR ART
FIG. 1 is a perspective view of a conventional single spout faucet assembly.
Figure 1A:
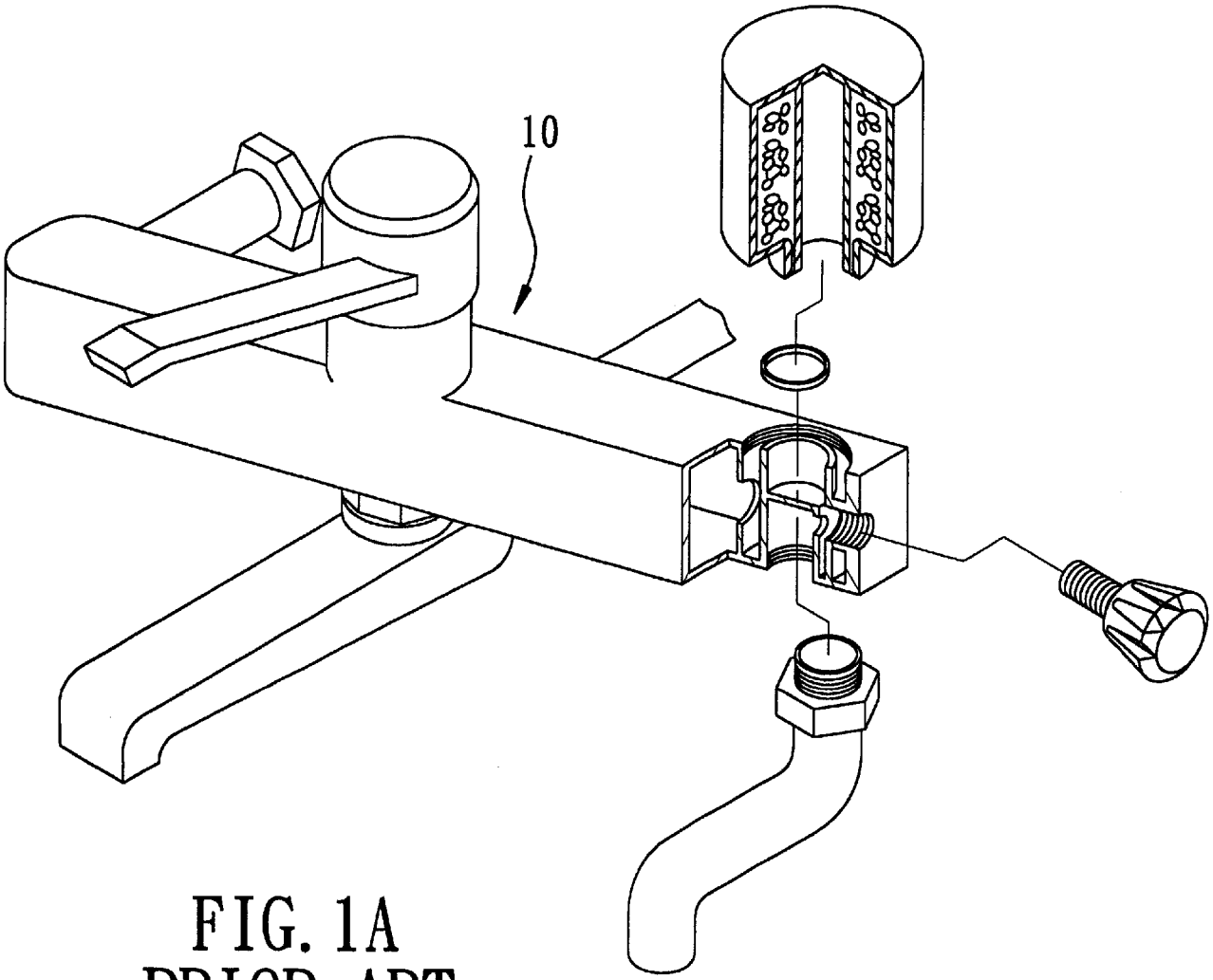
FIG. 1A PRIOR ART
FIG. 1A is an partly exploded view of a conventional two-spout faucet assembly.
Figure 2:
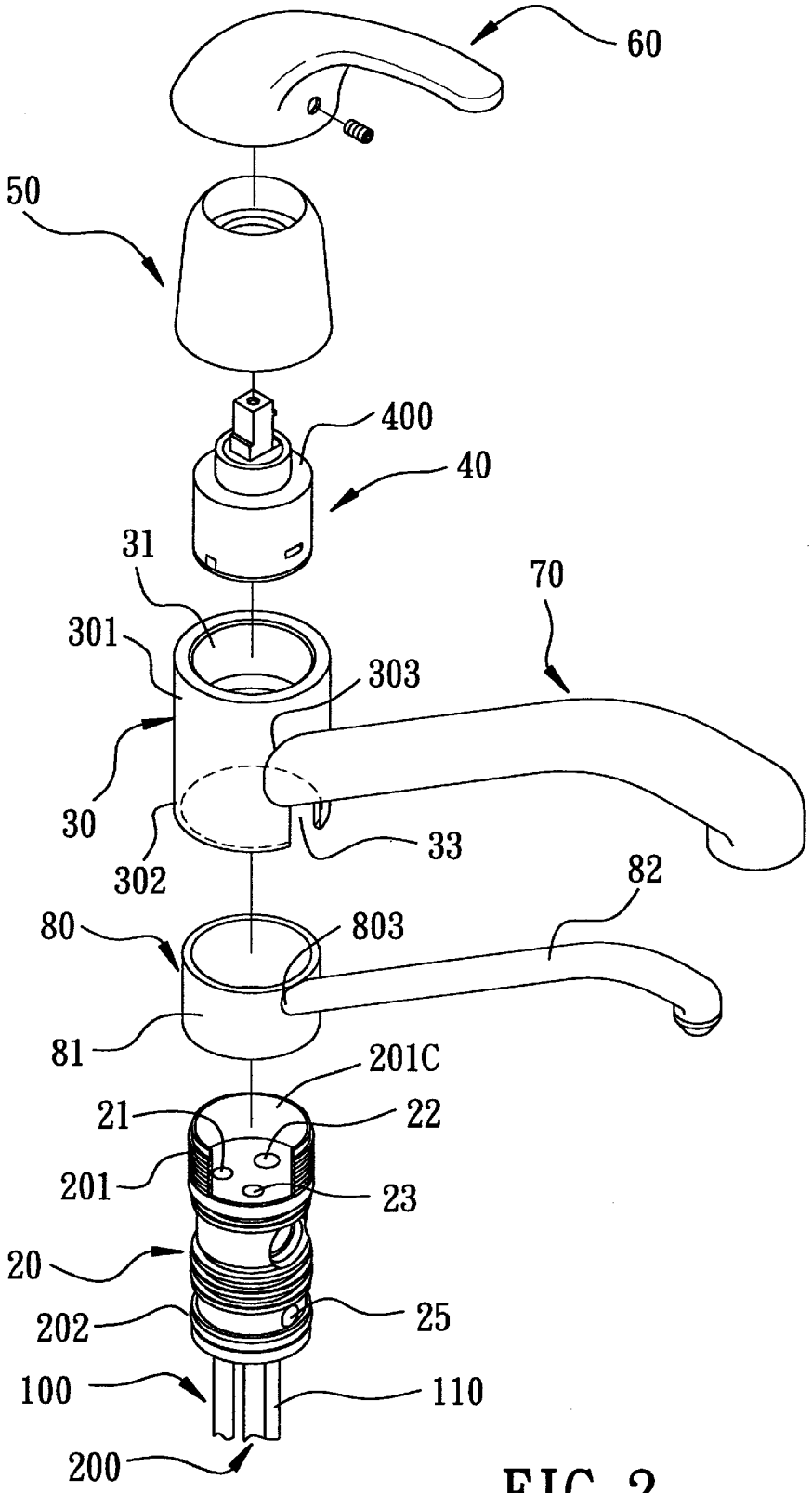
FIG. 2 is an exploded view of the preferred embodiment of a faucet assembly of the present invention.
Figure 3:
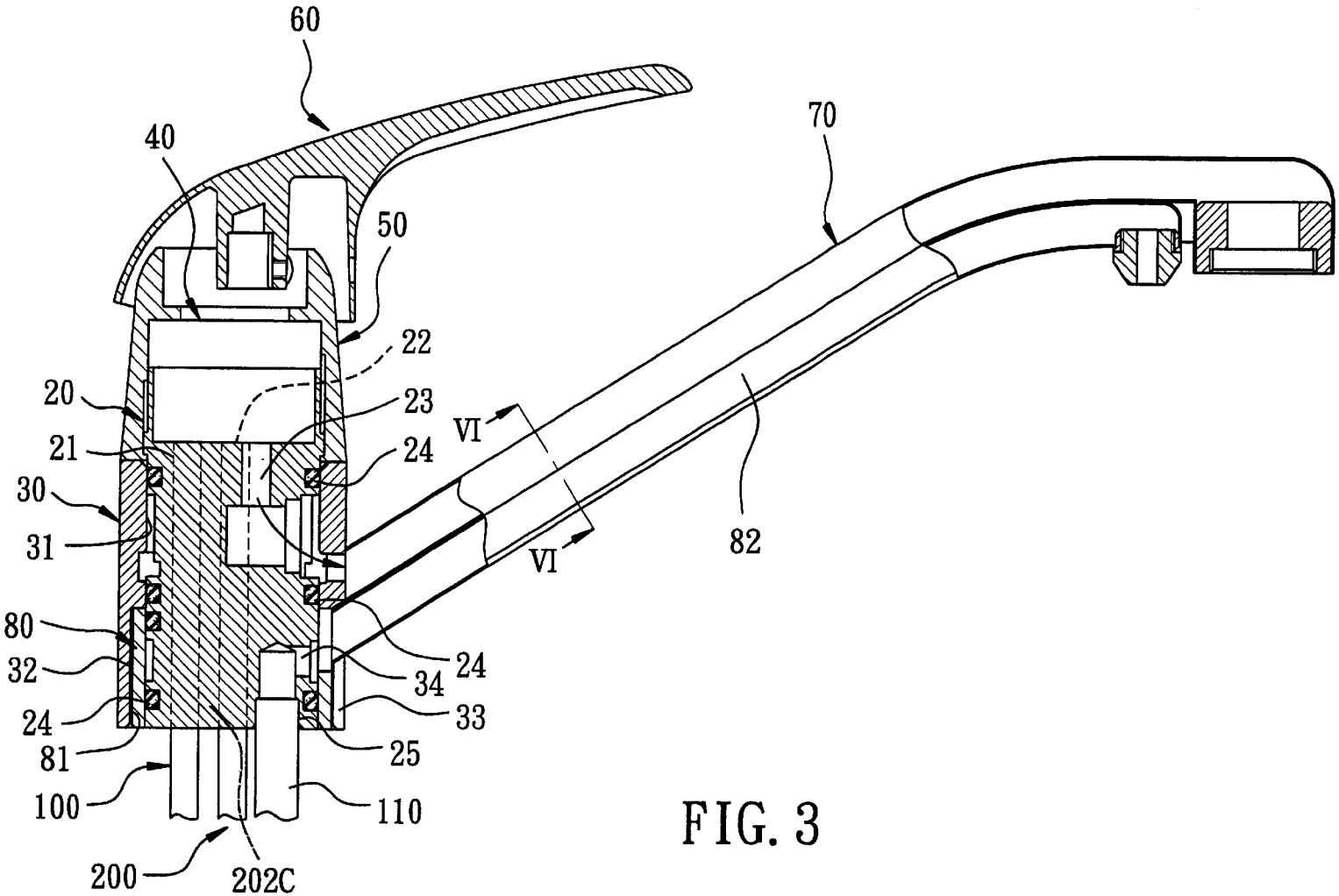
FIG. 3 is a sectional view of the preferred embodiment.
Figure 5:
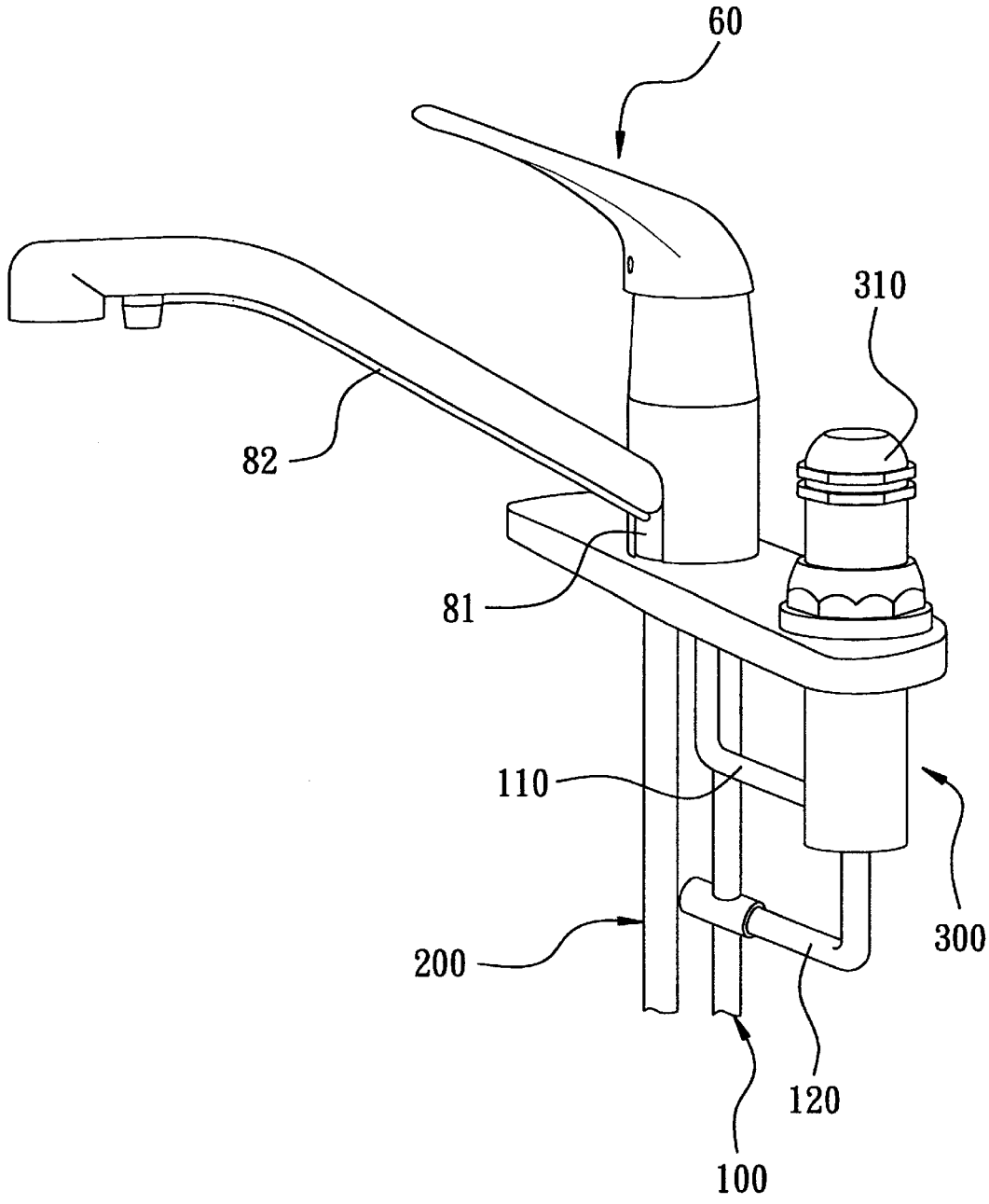
FIG. 5 is a perspective view of the preferred embodiment in use.

Referring to FIGS. 2 and 3, the preferred embodiment of a faucet assembly according to the present invention is shown to include a faucet body 20, a tubular housing 30, a hollow tube 80, a first spout 70, a second spout 82, a first control knob 40 and a second control knob 310 (see FIG. 5).

As illustrated, the faucet body 20 includes an upper faucet portion 201 defining a first water passage chamber 201C having a cold water inlet 21 adapted to be connected fluidly with a cold water supply source 100, a hot water inlet 22 adapted to be connected fluidly with a hot water supply source 200, and a first water outlet 23. The faucet body 20 further includes a lower faucet portion 202 defining a second water passage chamber 202C (see FIG. 3) that is isolated fluidly from the first water passage chamber 201C. The second water passage chamber 202C has an inlet (not visible) adapted to be connected fluidly with a filter device 300 (see FIG. 5) via a filter pipe 110 so as to receive filtered water therefrom, and a second water outlet 25 adapted for discharging the filtered water therefrom.

The housing 30 is sleeved rotatably around the faucet body 20, and includes an upper housing portion 301 that establishes a first water-tight seal in cooperation with the upper faucet portion 201 so as to define a first annular chamber 31 therebetween in communication with the first water passage chamber 201C via the first water outlet 23, and that is formed with a first spout mounting port 303. The housing 30 further has a lower housing portion 302 disposed around the lower faucet portion 202 and defining an annular tube accommodating space 32 therebetween.

The hollow tube 80 has an axial length and a width that are smaller than those of the tubular housing 30, and is disposed inside the tube accommodating space 32 defined between the lower faucet portion 202 and the lower housing portion 302. The tube 80 has a peripheral wall 81 with two opposite ends connected to the lower faucet portion 202 so as to establish a second water-tight seal and a second annular chamber 34 between the lower faucet portion 202 and the peripheral wall 81, and between the ends of the peripheral wall 81 in the tube 80. The second annular chamber 34 is in fluid communication with the second water passage chamber 202C via the second water outlet 25. The tube 80 further has a second spout mounting port 803 formed in the peripheral wall 81 and in fluid communication with the second annular chamber 34. Preferably, two pairs of rubber rings 24 are employed to form the first and second water-tight seals.

The first spout 70 extends integrally, radially and outwardly from the upper housing portion 301 and is in fluid communication with the first spout mounting port 303 for guiding water outwardly from the first annular chamber 31. Preferably, the first spout 70 has an inner end integrally connected to the periphery defining the first spout mounting port 303.

The second spout 82 is operably associated with the first spout 70 so as to synchronously rotate therewith relative to the faucet body 20. The second spout 82 extends generally parallel with the first spout 70 and through the lower housing portion 302 and connected integrally to the tube 80. The second spout 82 is in fluid communication with the second spout mounting port 803 so as to be adapted to guide the filtered water outwardly from the second annular chamber 34. Preferably, the second spout 82 has an inner end integrally connected to the periphery defining the second spout mounting port 803 in the tube 80.

The first control knob 40 is mounted on the tubular housing 30 for selectively closing and opening the cold and hot water inlets 21, 22 and the first outlet 23 upon operation thereof. Preferably, the first control knob 40 includes a valve confining seat 50 fixed on the top end of the housing 30 so as to define a valve accommodating space 31, a valve unit 400 disposed rotatably within the space 31, and an operating lever 60 disposed over the seat 50 and operably attached to the valve unit 400.

The second control knob 310 can regulate and stop flow of the filtered water to the second spout mounting port 803 in the tube 80. In this embodiment, a rotary valve serves as the second control knob 310. Since the structure of the rotary valve is not pertinent to the present invention, a detailed description of the same is omitted herein for the sake of brevity.

Figure 4:
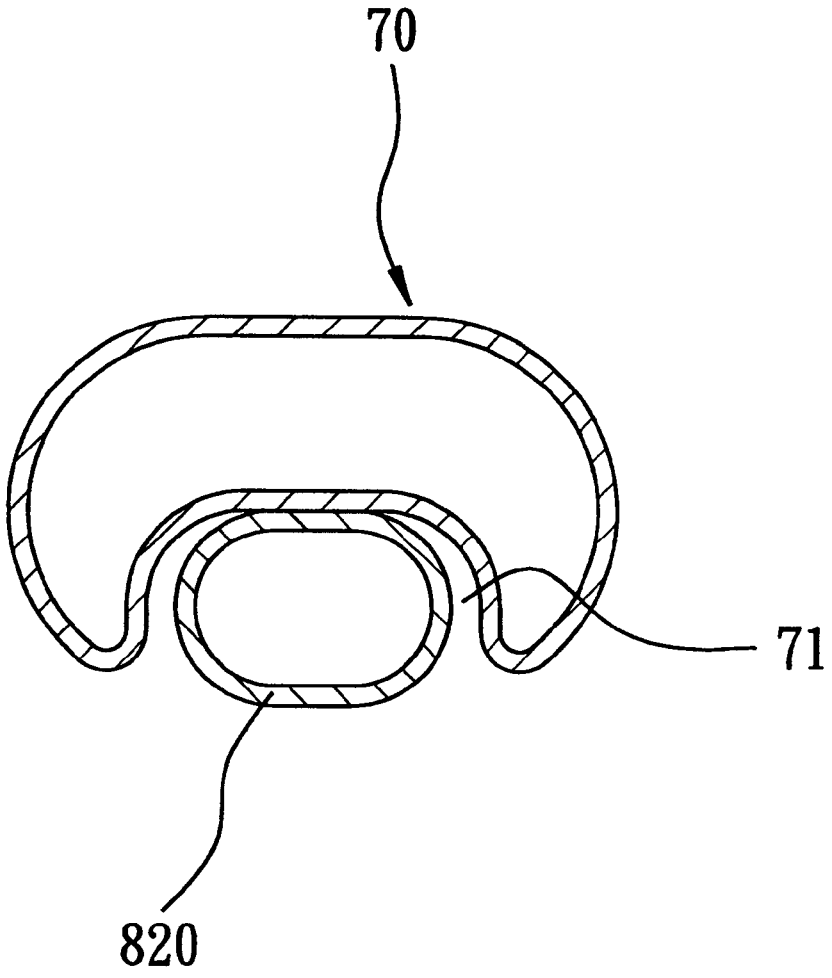
FIG. 4 is a sectional view of the preferred embodiment taken along lines IV—IV in FIG. 3.

In this embodiment, the first spout 70 includes a spout pipe of an inverted U-shaped cross-section extending from the housing 30 generally in a horizontal direction, and defines an accommodating slot 71 therein (see FIG. 4). The second spout 82 has an intermediate spout body 820 (see FIG. 4) of oval-shaped cross section received in the accommodating slot 71 in the first spout 70 so as to be co-rotatable with the first spout 70.

Preferably, the lower housing portion 302 in the housing 30 has a notch 33 formed in a lower end thereof and in communication with the slot 71 in the first spout 70. Under this condition, the second spout 82 extends into the slot 71 in the first spout 70 through the notch 33 in the lower housing portion 302.

A connecting pipe 120 is employed to supply cold water to the filter device 300.

Since the first and second spouts 70, 82 are disposed in an overlapping manner, a volume-reduced sink is required to be disposed under the faucet assembly of the present invention. The object of the invention is thus met.

With this invention thus explained, it is apparent that numerous modifications and variations can be made without departing from the scope and spirit of this invention. It is therefore intended that this invention be limited only as indicated by the appended claims.

I claim:

1. A faucet assembly comprising:

a faucet body including an upper faucet portion defining a first water passage chamber having a cold water inlet adapted to be connected fluidly with a cold water supply source, a hot water inlet adapted to be connected fluidly with a hot water supply source and a first water outlet, and a lower faucet portion defining a second water passage chamber isolated fluidly from said first water passage chamber, said second water passage chamber having an inlet adapted to be connected fluidly with a filtered water source so as to receive filtered water therefrom, and a second water outlet adapted for discharging the filtered water therefrom;

a tubular housing sleeved rotatably around said faucet body, and including an upper housing portion that establishes a first water-tight seal in cooperation with said upper faucet portion so as to define a first annular chamber therebetween in communication with said first water passage chamber via said first water outlet, and that is formed with a first spout mounting port, and a lower housing portion disposed around said lower faucet portion and defining an annular tube accommodating space therebetween;

a hollow tube of an axial length and a width that are smaller than those of said tubular housing, said hollow tube being disposed inside said tube accommodating space, and having a peripheral wall with two opposite ends connected to said lower faucet portion so as to establish a second water-tight seal and a second annular chamber between said lower faucet portion and said peripheral wall and between said ends of said peripheral wall of said tube and in fluid communication with said second water passage chamber via said second water outlet, said tube having a second spout mounting port formed in said peripheral wall and in fluid communication with said second annular chamber;

a first spout extending integrally, radially and outwardly from said upper housing portion and in fluid communication with said first spout mounting port for guiding water outwardly from said first annular chamber;

a second spout operably associated with said first spout so as to synchronously rotate therewith relative to said faucet body, said second spout extending generally parallel with said first spout and through said lower housing portion and being connected integrally to said tube and in fluid communication with said second spout mounting port so as to be adapted to guide the filtered water outwardly from said second annular chamber;

a first control knob mounted on said tubular housing for selectively closing and opening said cold and hot water inlets and said first outlet upon operation thereof; and a second control knob adapted to regulate and stop flow of the filtered water to said second spout mounting port in said tube.

2. The faucet assembly as defined in claim 1, wherein said first spout includes a spout pipe of an inverted U-shaped cross-section extending from said housing generally in a horizontal direction and defining an accommodating slot therein, said second spout including an intermediate spout body received in said accommodating slot in said first spout so as to be co-rotatable with said first spout.

3. The faucet assembly as defined in claim 2, wherein said lower housing portion has a notch formed in a lower end thereof and in communication with said slot in said first spout, said second spout extending into said slot in said first spout through said notch in said lower housing portion.

* * * * *